US010299608B1

(12) United States Patent
Shi

(10) Patent No.: US 10,299,608 B1
(45) Date of Patent: May 28, 2019

(54) CHILD BED FALL BLOCKING SYSTEM

(71) Applicant: Vivian Shi, Chicago, IL (US)

(72) Inventor: Vivian Shi, Chicago, IL (US)

( * ) Notice: Subject to any disclaimer, the term of this patent is extended or adjusted under 35 U.S.C. 154(b) by 1 day.

(21) Appl. No.: 16/124,953

(22) Filed: Sep. 7, 2018

(51) Int. Cl.
*A47D 7/02* (2006.01)
*A47D 7/00* (2006.01)

(52) U.S. Cl.
CPC ..... *A47D 7/02* (2013.01); *A47D 7/005* (2013.01)

(58) Field of Classification Search
CPC ..... A47D 7/00; A47C 21/08
USPC ..... 5/425–429
See application file for complete search history.

(56) References Cited

U.S. PATENT DOCUMENTS 2,667,647 A * 2/1954 Reggiani ..... A47D 7/04 5/425
5,577,277 A * 11/1996 Sundberg ..... A47C 21/08 5/425
6,886,196 B2 * 5/2005 Nygren ..... A47C 21/08 5/426
6,952,847 B1 * 10/2005 Cleary ..... A47C 21/08 5/426
7,028,353 B2 * 4/2006 Waldman ..... A47C 21/08 5/426
7,055,193 B2 * 6/2006 Macari ..... A47C 21/08 5/425
2009/0070931 A1 * 3/2009 DiCristofaro ..... A47C 21/08 5/428

* cited by examiner

*Primary Examiner* — Joshua T Kennedy

(57) ABSTRACT

A Child Bed Fall Blocking System is an apparatus that offers safety barriers to prevent small children from falling out of a child's or adult's bed by providing full protection on all 3 exposed sides of the bed. The barriers can be raised and lowered easily to provide easy ingress and egress for adults, and can be collapsed and hidden when not in use. The Child Bed Fall Blocking System that can be installed easily, consists of 4 base plates connected with 3 wires and 2 separate reinforcing wires along the headboard side of the bed, a set of 2 tabs attached to each base plate, 6 vertical height-adjustable telescopic pole sets attached to the base plates, 3 sets of length-adjustable tube sets connecting the inner telescopic poles with hinges, 6 lock systems, and 3 adjustable fabric panels, each secured by a flat bar on the bottom of the panel.

10 Claims, 5 Drawing Sheets

CHILD BED FALL BLOCKING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to the Classification (NO. A47D)—Furniture Specially Adapted for Children

2. Description of the Related Art

Any discussion of the prior art throughout the specification should in no way be considered as an admission that such prior art is widely known or forms part of common general knowledge in the field.

The only device currently available on the market for preventing a child from falling off a bed is widely known as a bed rail. However, one bed rail can only be attached to a portion of one side of a bed, leaving large areas along the bed sides wide open without blockage, where a child can fall off the bed. As such, bed rails are not safe for infants (<1 year of age) and young toddlers (1-2 years of age). Additionally, it's difficult for an adult to get out of the side of the bed to which a bed rail is attached.

There are a few patented devices that are designed to be attached to a bed or crib to prevent people from falling out of their bed or crib. For example,

- U.S. Patent No. US20090070931 is a portable bed guard which can only be attached to one side of a crib with a side bed rail;
- U.S. Patent No. US20160310336 is a telescopic bed side rail attachable only to hospital beds to prevent patients from falling off hospital beds;
- U.S. Patent No. US20160058199 is a platform device attached to one side of a bed to receive a child falling off a bed;
- U.S. Patent No. US20060000017 is a device which can only be attached to one side of a crib combining a side rail and a ramp structure to prevent a child from rolling out of a crib.

The present invention, the Child Bed Fall Blocking System, protects a baby or small child from falling out of bed, including child size beds and conventional adult beds, by creating barriers on all exposed sides of a bed continuously, providing much more full protection than the prior art. Furthermore, the Child Bed Fall Blocking System with 4 quadrant-shaped base plates connected with 3 flexible wires can be easily installed by inserting the base plates under 4 corners of a mattress, one base plate for each corner at a time. Lastly but not least, the barriers provided by the Child Bed Fall Blocking System are collapsible by lowering the telescopic poles, one at a time, at each corner of the bed, which provides a convenient way for adults to get in and out of the bed by lowering just one telescopic pole at any bed corner, while keeping the rest of barriers intact without impacting the effectiveness of the full protection for the child on the bed.

In these respects, the Child Bed Fall Blocking System according to the present invention substantially departs from the conventional concepts and designs of the prior art, and in so doing provides an apparatus primarily developed for the purpose of providing i) secured indiscrete barriers along all open sides of a bed to prevent infants and young toddlers from rolling or falling off the bed when sleeping or playing on the bed, ii) easy installation, and iii) convenience for mothers breast feeding babies and parents co-sleeping with infants and small children to get in and out of the bed easily without removing the entire barrier panel along the bed sides.

BRIEF SUMMARY OF THE INVENTION

In the wake of experiencing my own baby rolling off my bed a few times accidentally and the research finding that most babies accidentally fall off a bed at least once in their early lives no matter how careful their parents are because babies move very fast and unpredictably, especially when they are 6-15 months old, I am determined to develop a system that can completely block all open sides of a bed to provide infants and small children with maximum protection from falls from any open area along all sides of a bed.

A primary object of the present invention is to provide a continuous barrier along all of the open sides of a bed. This is achieved by a combination of i) a height-adjustable telescopic pole set vertically attached to a quadrant-shaped base plate at each corner of a bed, ii) a length-adjustable tube set horizontally connecting each of the inner telescopic pole along each of bed sides (except for the side where the headboard is located which already provides intrinsic barrier), and iii) fabric fastened on the length-adjustable tube set (on the top), the height-adjustable inner telescopic poles (on the side) at each bed corner, and a horizontal flat bar (on the bottom of the adjustable barrier panel) connecting the outer telescopic poles. The fabric can be a type of mesh net to avoid potential suffocation risk for infants and small children.

Another object of the present invention is to provide an apparatus that is easy to be installed. This goal is achieved by the agility of each base plate connected by a flexible wire. Each base plate can be inserted underneath a mattress one corner at a time. Because of the ease of installation, the entire installation can be managed by one person by lifting one corner of a mattress and inserting one base plate at a time. Additionally, each straight side of the quadrant-shaped base plate has a tab attached vertically to the base to prevent the base plate from shifting in any direction. The combination of the tab and wire attached to each base plate secures and stabilizes the base plate underneath each corner of a mattress free of any motion. Furthermore, two additional separate wires—one connecting two tabs located at each corner along the headboard, the other connecting two outer telescopic poles at each corner along the headboard—further reinforce the stability and security of the base structure and the entire Child Bed Fall Blocking System.

The final object of the present invention, which is very important and can determine how useful and practical it is to use the Child Bed Fall Blocking System in daily life, is easy access into and out of the bed when the Child Fall Blocking System is in use blocking all of the open sides of a bed. This function is made possible by the individual adjustability of the telescopic poles and tube sets connecting those poles. Each set of tubes connecting 2 height-adjustable poles (i.e. the inner vertically movable pole of the telescopic pole set) on each end, consists of an inner tube and an outer tube. The inner tube is inserted into the outer tube with each tube connected to the top of the inner telescopic pole with a hinge at each corner of a bed side.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughput the several views and wherein.

DETAILED DESCRIPTION OF THE INVENTION

A. Overview

Figure 1:
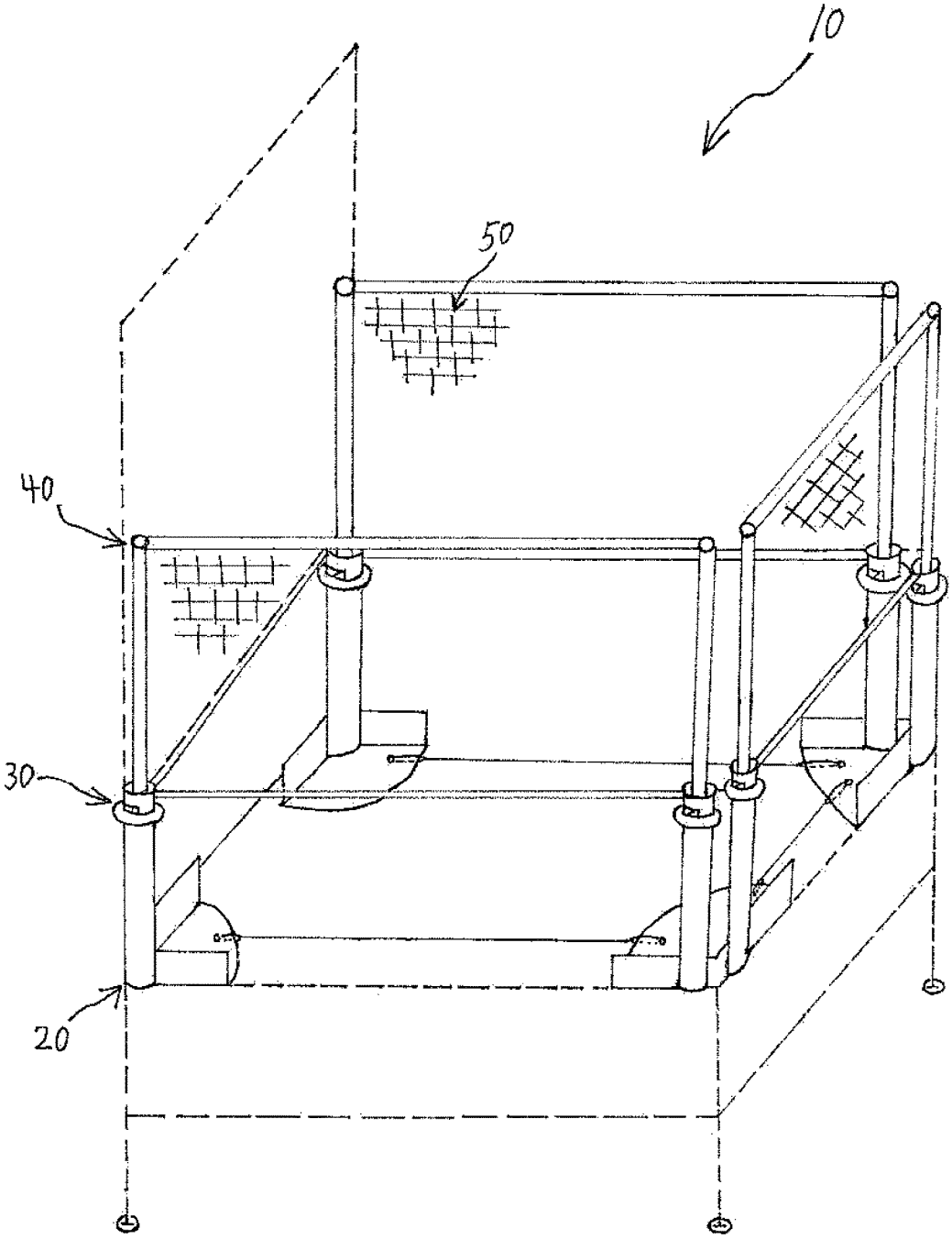
FIG. 1 is an upper perspective view of the present invention with breathable fabric, such as a mesh or net material, fastened on each adjustable barrier panel, along a bed side, secured by a flat bar on the bottom of the panel and a horizontal tube set on the top, and wrapped around the height-adjustable inner pole of the telescopic pole on both sides of each panel with a set of rings (line 52).

Turning now descriptively to the drawings, in which similar reference characters denote similar elements throughout the several views, FIG. 1 through 9 illustrate a Child Bed Fall Blocking System 10, which comprises A) a base member 20, including i) a wire 24 fastened to the hole 23 of the quadrant-shaped base plate 21 with an oval shaped ring 25, ii) two tabs 22, each vertically connecting to each straight side of the quadrant shaped base plate 21, and iii) the outer pole 31 of a telescopic pole set, which is attached by the two tabs 22 and base plate 21 on the bottom of the outer pole to form a fixed base member; B) an adjustable panel member 40 consisting of i) a height-adjustable inner pole 41 of the telescopic pole, ii) a length-adjustable horizontal tube set 43 on the top of the adjustable panel, and iii) a hinge 42 connecting both the height-adjustable inner pole 41 and the length-adjustable horizontal tube 43 and allowing both adjustable parts (i.e. 41 and 43) to move in sync to raise or lower the inner telescopic pole when the Child Bed Fall Blocking System 10 is expanded in use or collapsed not in use; C) a lock system 30 consisting of i) a revolving locking ring 32 and ii) two locking pins 33; and D) a fabric member 50 in a form of mesh or net material breathable to avoid potential suffocation risk, slid onto the adjustable barrier panel consisting of the length-adjustable tube set 43 on the top, the height-adjustable inner pole 41 of the telescopic pole set on the side with a set of rings 52, and a flat bar on the bottom of the barrier panel.

B. Base Member

Figure 2:
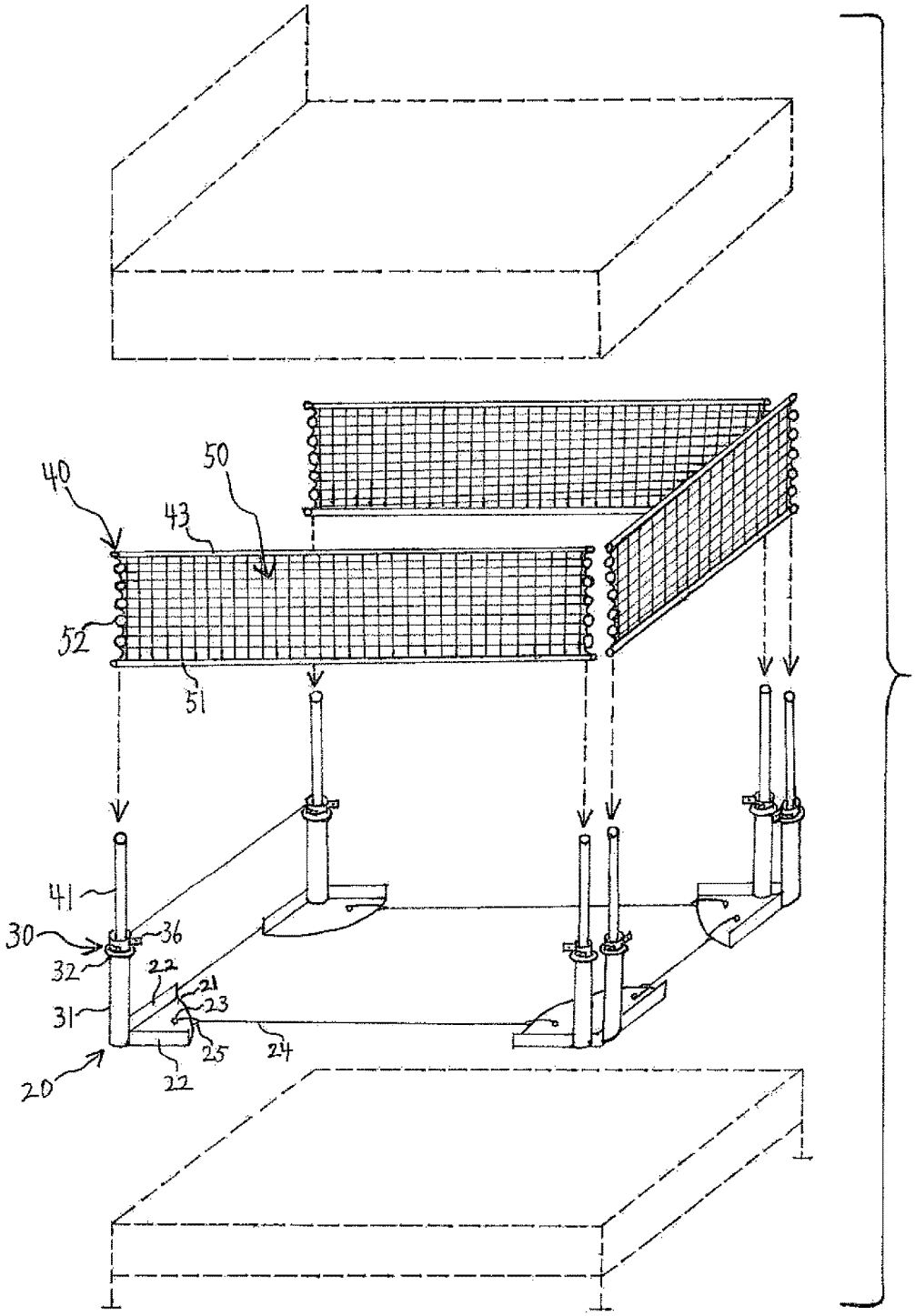
FIG. 2 is an exploded upper perspective view of the present invention.
Figure 3:
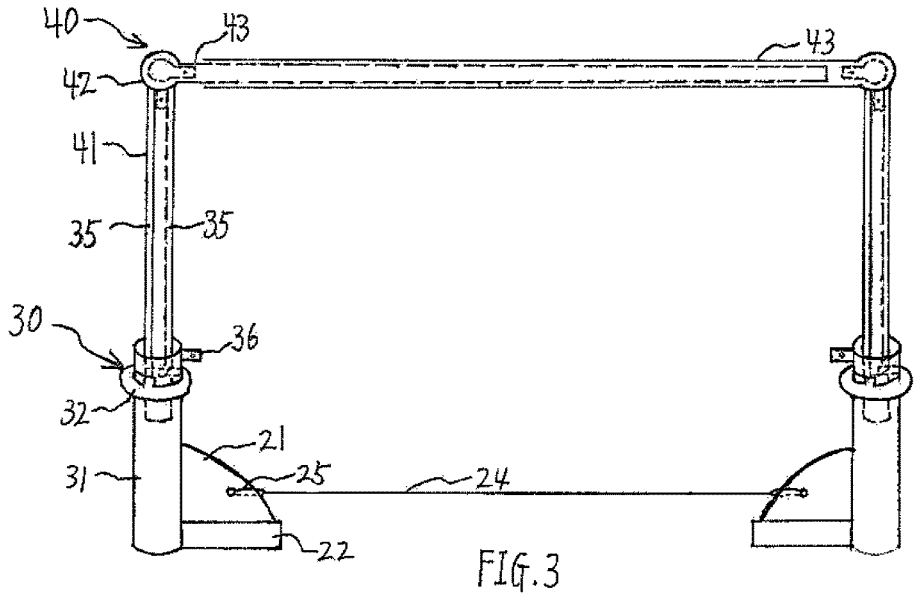
FIG. 3 is a front view of the base member 20 (lines 21-25) and the adjustable panel 40 (lines 41-43) along one side of a bed.
Figure 4:
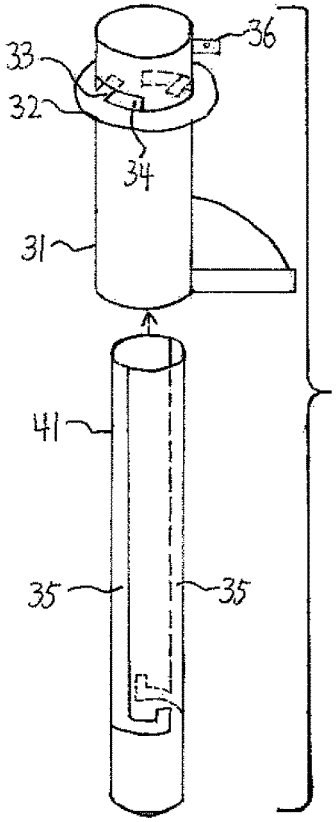
FIG. 4 is an exploded upper perspective view of the telescopic pole set (lines 31 and 41) depicting the locking track of the adjustable pole 41 and illustrating assembly of the telescopic pole set.
Figure 5:
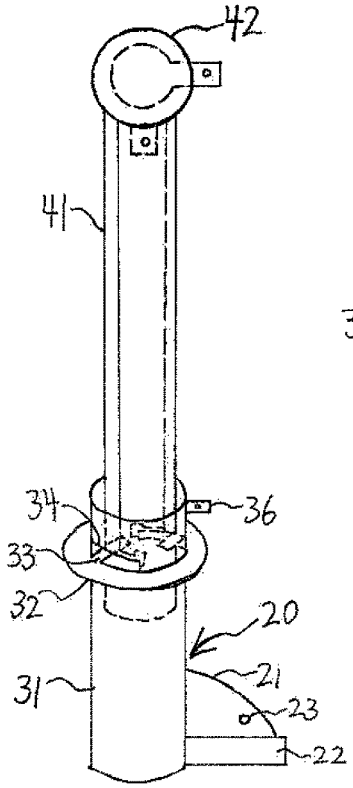
FIG. 5 is a sectional view of the lock system 30 connecting the outer base pole 31 and the inner pole 41 of a telescopic pole set which is also connected to a hinge 42 on the top of the inner pole.
Figure 6:
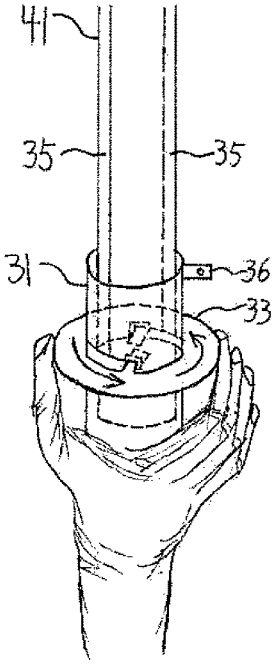
FIG. 6 is a sectional view of lock system 30 (lines 31-35) being turned to a lock position when in use.

The base member 20 is preferably comprised of a configuration to fit underneath the mattress at the corners, as illustrated in FIG. 1 through 3. The base member 20 preferably consists of a quadrant-shaped base plate 21, two tabs 22 vertically connected to the two straight sides of the quadrant-shaped base plate, and the outer pole 31 of a telescopic pole set. Each outer pole 31 is embedded with the lock system 30 toward the top of the pole, where a small tab 36 is attached to be fastened to a flat bar 51 that connects the top of two neighboring outer poles 31 and functions as a gap closer to eliminate a potential small space between the side of a mattress and the fabric blocker 50.

The base plate 21 includes one or two holes 23 on the quadrant-shaped plate depending on the location of the base plate relative to the bed—the base plates by the headboard have one hole while the base plates by the end of the bed have two holes. A wire 24 is preferably hooked into the hole 23 on the base plate with an oval shaped ring 25, which allows the base member 20 to freely move in all directions without constraints or conditioning upon certain positions of a base member 20. This flexible connection structure between the hole 23 on the base plate 21 and wire 24 with an oval shaped ring 25 makes the installation of the base member 20 easy as a user can lift a mattress corner up slightly with one hand while using the other hand to insert one base plate 21 under the mattress corner at a time. Once one base member 20 is inserted under a mattress corner, the user can move to the next bed corner and repeat the same insertion action. The wire 24 connecting two base plates 21 will be automatically be pulled under the mattress and stay taut along the bed side when the base member 20 is securely installed underneath the mattress at each bed corner. Additionally, the two base members 20 along the side of the bed headboard are connected with two separate wires that are individually fastened onto them—one wire on the bottom connects two tabs 22 located at the headboard corners along the headboard side; the other wire on the top connects two outer poles 31 located at each side of the headboard—to secure the base plates 21 under the mattress and stabilize the base members 20 as a whole.

The tab 22 is vertically connected to each of the straight sides of the quadrant-shaped base plate 21.

The addition of the tabs to each base plate, along with the wires 24 connecting all base members 20 taut underneath the mattress, except for the gap between the two base members by the bed headboard which has two reinforcement wires connecting the two tabs and outer poles along the headboard at each side, is to firmly secure the base member 20 and prevent it from sliding off the mattress corner.

Each of the base members by the bed headboard includes only one outer pole 31 of a telescopic pole, whereas each of the base members by the end of the bedside has two outer poles 31, because the headboard serves as a natural blocker and no additional blockage is needed for that side of a bed.

C. Adjustable Barrier Panel Member—Telescopic Pole Set (Vertical) and Tube Set (Horizontal)

Figure 7:
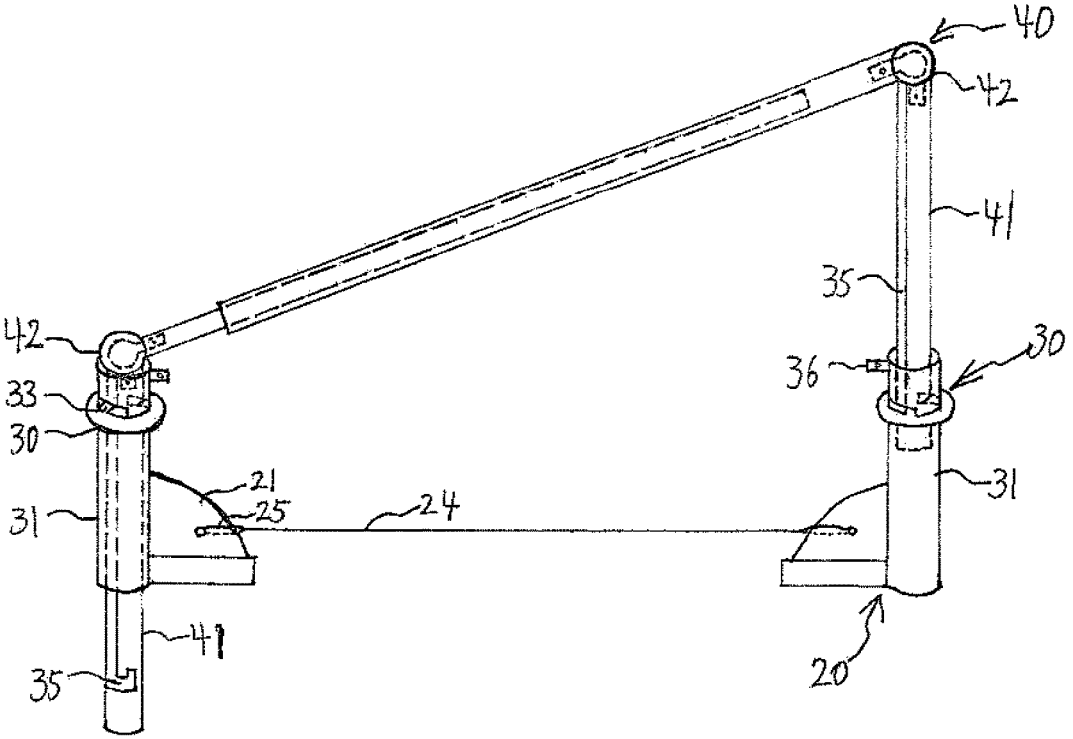
FIG. 7 is a sectional view of the adjustable panel 40 consisting of the base member 20 (lines 21-31), the lock system 30 (lines 32-35), the adjustable panel 40 (lines 41-43) being adjusted lower on one side.
Figure 8:
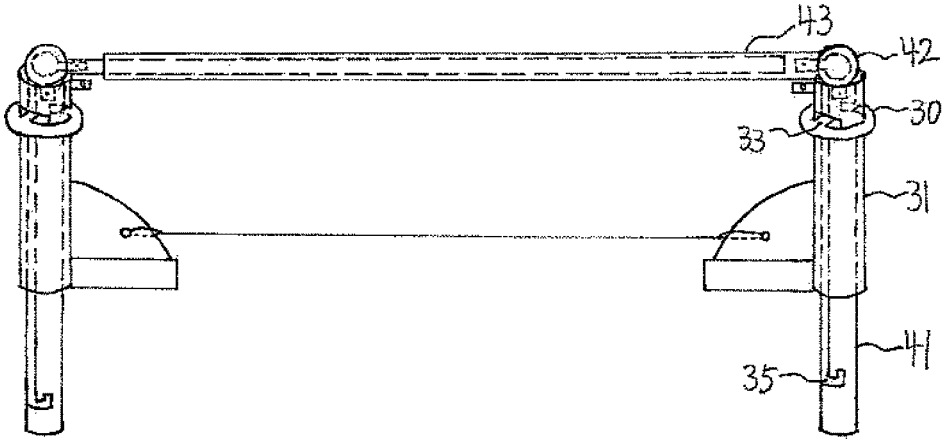
FIG. 8 is a sectional view of the inner telescopic poles (line 41) on both sides which are lowered completely and collapsed into their corresponding outer pole (line 31) which is part of the base member 20.

The adjustable panel member 40, as illustrated in FIG. 3 and FIG. 7 through 8, is preferably comprised of a vertically adjustable telescopic pole 41 on each side, longitudinally adjustable tube set 43 on the top and a hinge 42 connecting the adjustable pole and tube.

The vertically adjustable inner telescopic pole 41 has a smaller diameter than the outer pole 31 connecting to the base plate 21 and is able to slide inside of the outer pole 31 for vertical adjustment.

When the Child Bed Fall Blocking System 10 is expanded in use, the adjustable inner telescopic pole 41 is pulled up and is locked in a secured position by locking pins 33.

The adjustable tube set 43 on the top of the adjustable panel member 40 is comprised of two cylinder tubes with one in a smaller diameter than the other, which allows the tube with a smaller diameter to slide longitudinally inside the other, increasing or decreasing the length of the adjustable tube set 43.

The hinge 42 is preferably comprised of two identical round shaped plates and two sets of bolts and nuts.

One set of bolts and nuts is to fasten the top end of the adjustable telescopic pole 41 between the two round shaped plates and the other set is to fasten one end of the adjustable tube 43 between the two plates. The distance between the two identical round plates is the same as or slightly larger than the diameter of both adjustable pole and tube so that the adjustable pole and tube can be more in sync, especially when only one inner telescopic pole 41 on one side of the adjustable panel member 40 is being raised or lowered. This flexible structure allows the user to lower one telescopic pole at a time, instead of having to lower the poles on both sides of a bed at the same time. This is critically important because it enables an adult to access or exit the bed with the minimum opening unblocked. It prevents an active child from rolling off the bed from the farther end of the same bedside, which is out of the adult's reach, when the adult is exiting the bed or in the process of changing the child's diapers.

D. Lock System

The lock system 30, as illustrated in FIG. 3 through 6, is preferably comprised of a revolving locking ring 32 and two locking pins 33 that are connected to the locking ring 32 and extended into the "J"-shaped tracks 35 of the inner telescopic pole 41 through the openings 34 of the outer pole 31. Each of the locking pins 33 is long enough to extend into the adjustable inner telescopic pole 41 through a rectangular opening of the outer telescopic pole 31 so that the locking pin 33 can lock the position of the telescopic pole set when in use, and it prevents the inner telescopic pole 41 from sliding down. Additionally, the lock system 30 is preferably assisted with two "J"-shaped tracks 35 carved out along the sides of an inner telescopic pole 41 to allow the inner pole 41 to slide into the outer pole 31 from the bottom of the outer pole, to move up and down inside the outer pole, and to be locked in the extended position by the locking pin 33 when the inner pole 41 is fully expanded upwards in use. As such, to collapse the barrier panel by unlocking the inner pole and lowering it down, the inner pole needs to be raised slightly while the locking ring is being turned. This locking and unlocking mechanism is designed to be sophisticated enough to prevent children from accidentally unlocking the extended barrier panel in use.

E. Fabric Member

Figure 9:
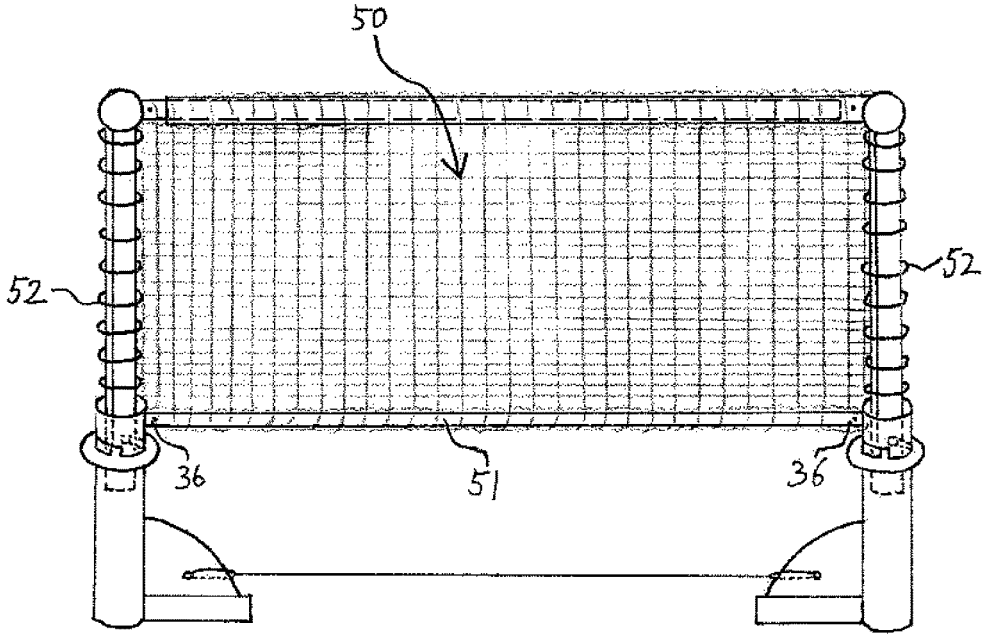
FIG. 9 is a sectional view of the fabric member with a set of rings (line 52) along both sides and a sleeve on the top and bottom of the fabric member, which connects the adjustable tube (line 43) on the top, a flat bar (line 51) on the bottom, and the inner telescopic pole (line 41) on each side of the adjustable panel member 40 along a bed side.

The fabric member 50, as illustrated in FIGS. 1 and 9, is preferably a type of breathable fabric, such as mesh or net material, with a set of rings 52 along both sides and a sleeve on the top and bottom of the fabric member, connecting the adjustable tube 43 on the top, the flat bar 51 on the bottom, and the height-adjustable inner pole 41 of the telescopic pole on each side of the adjustable panel member 40 along a bed side. The fabric member 50 is preferably an upside down isosceles trapezoid, with an elastic sleeve on the top that accommodates the movement of the longitudinally adjustable tube set 43 on the top, a set of rings 52 that connect the fabric to the vertically adjustable inner telescopic pole 41 on the sides, and a fixed length sleeve on the bottom connecting the flat bar 51. The fabric member's sleeve structure accommodates the adjustable tube set 43 to slide into an elastic longer sleeve on the top and a fixed length flat bar 51 to slide into a fixed length sleeve on the bottom. The fabric member 50 and the flat bar 51 connecting two neighboring outer poles 31 via the small tab 36 are instrumental in blocking children from falling off a bed, as they, along with the main frame of adjustable panel member 40, create a solid complete barrier and full protection, while providing not only flexible access, benefiting from the adjustable feature of the adjustable panel member 40, but also a breathable surface which does not present a suffocation hazard for children.

E. In Use

In use, first, the user slides the inner telescopic pole 41 individually into the outer pole 31 of the base member 20 by inserting the top of the inner pole 41 into the outer pole 31 from the bottom of the outer pole.

Second, the user raises the inner telescopic pole and turns the locking ring 32 until the inner adjustable telescopic pole is in a secured locking position and becomes immobile.

Third, the user lifts a mattress corner up slightly, inserts the corresponding base plate 21 underneath it until the tab 22, which is vertically attached to each straight side of the quadrant-shaped base plate 21, aligns tightly against the mattress side surface at each bed corner, and then lays the mattress corner back down. The user repeats the same installation to insert the other base plates 21 underneath the other mattress corners, one base plate insertion under one mattress corner at a time. The user then fastens each end of a separate wire to each of the two vertical tabs symmetrically located along the side of the headboard. Next, the user fastens each end of another separate wire to each of the two vertical outer poles symmetrically located along the side of the headboard. As the user inserts the base plates 21 under the mattress corners and fastens the two separate wires 24 at each corner of the bed headboard, the wires 24 connecting all of the base plates 21 are automatically pulled underneath the mattress, parallel to the corresponding mattress edges, and kept taut. As such, the base members 20 are secured and stabilized.

Forth, the user slides a set of rings 52 located on the side of the fabric member 50 onto the inner telescopic pole 41 from the top of the pole.

Fifth, the user fastens the hinge 42 to the top of the inner telescopic pole 41.

Sixth, the user slides the adjustable tube set 43 into the elastic sleeve of fabric member 50 at the top end of the fabric member 50 and then fastens each end of the adjustable tube set 43 to the corresponding hinge 42 with a bolt and nut, so that the vertically adjustable inner pole 41 on the side is connected to the adjustable tube 43 on the top through the hinge 42, and the adjustable inner pole 41 can be slid up and down in the outer base pole 31 facilitated by the flexibility of the hinge 42 and adjustability of the length-adjustable tube set 43.

Finally, to complete the adjustable panel member 40 and create a closed solid blockage to prevent children from rolling off a mattress, the user slides a flat bar 51 into the bottom sleeve of the fabric member 50, and then fastens each end of the flat bar 51 to a small tab 36 attached to the top of the outer poles 31 at each bed corner.

The Child Bed Fall Blocking System 10 is now ready for use. When in use, to expand the adjustable barrier panel, the user raises the inner telescopic pole until it can't be raised further, and then turns the locking ring until it can't be turned further. The barrier panel is now firmly locked. When not in use, to collapse the adjustable barrier panel, the user raises the inner telescopic pole slightly, while turning the locking ring in the opposite direction until it can't be turned further, then lowers the inner telescopic pole until it can't be lowered further. The barrier panel is then completely collapsed.

When the system is not in use, the user can leave the system installed and keep the inner poles 41 completely collapsed inside the outer poles 31 with the top of the inner poles 41 resting on the top of the outer pole 31, and the fabric member 50 automatically folds along the mattress sides, which stays clear for getting on and off the bed. When a child is on the bed, the user can slide the inner poles 41 up and lock them in a fully extended position by turning the lock ring 32 into a locked position, where the locking pins 33 lock into the locking point of the track 35. Once all of the adjustable inner poles are extended and locked, the blocking panels are formed which can securely block a child from rolling off the bed. At any given time if the user needs to get on or off the bed from one corner of the bed while keeping the blocking panel effective for the child on the bed, the user can lower just one inner pole 41 at the corner of the bed where the user wishes to access or exit the bed. As such, the child is protected with the maximum blockage possible while still allowing the adult user to access or exit the bed.

I claim:

1. A Child Bed Fall Blocking System, comprising:

a base member comprising four separate quadrant-shaped base plates, with a tab perpendicularly attached to each straight side of said base plate, at least one outer pole attached to each of said base plates adjacent an intersection of said straight sides of each said base plates, each outer pole comprising at least one lateral opening, three flexible wires, each wire connecting two of said base plates in series such that, when in a fully extended configuration, the wires and base plates to which they are connected define three non-headboard sides of said system, two separate wires, one of said separate wires connecting tabs of said base members positioned along a headboard side and the other one of said separate wires connecting two outer poles attached to the base members positioned along said headboard side;

an adjustable barrier panel member extending between two of said outer poles along each of the non-headboard sides, each panel comprising two inner poles, each of said inner poles telescopic connected with a respective one of said two outer poles along each of the non-headboard sides, each inner pole having at least one "J" shaped track two tubes, each of said tubes attached to a top end of each of said inner poles having a hinge, an adjustable tube set, comprised of said two tubes, extending between said hinges, and a removable fabric member extending between said inner poles on the sides of the fabric member, said adjustable tube set on the top of the fabric member and a flat bar along the bottom of the fabric member; and a lock system mounted on each of said at least one outer pole, each lock system comprising a revolving locking ring having at least one locking pin, each of said at least one locking pin configured to extend into a respective one of the at least one "J"-shaped tracks of said inner poles through a respective one of the at least one lateral openings of said outer poles, wherein said locking ring, in a locked position, can be turned in a first rotation direction at the same time lifting up the connected inner pole slightly, to unlock the telescopic pole set and allow said inner poles to telescope within said outer poles while the locking pins move up and down inside the "J"-shaped tracks of the inner pole; and wherein said lock system is configured where said lock ring can be turned in opposite rotation direction to lock the expanded adjustable barrier panel at such a secured position that children can't accidentally unlock the extended barrier panel in use.

2. The Child Bed Fall Blocking System of claim 1, wherein each of the base plates is configured to be inserted underneath corners of a mattress such that the straight lines of each of said base plates are configured to align with the side of the mattress corner.

3. The Child Bed Fall Blocking System of claim 1, wherein said wires are connected to said base plates in such way where the wires are configured to slide underneath a mattress when the user inserts base plates under mattress corners one at a time.

4. The Child Bed Fall Blocking System of claim 1, wherein each wire is configured to be pulled taut by the tabs during installation of the system.

5. The Child Bed Fall Blocking System of claim 1, wherein each outer pole is attached perpendicularly to each respective base plate.

6. The Child Bed Fall Blocking System of claim 5, wherein when each panel is in a full blocking position, each of said inner poles is fully extended relative to each corresponding outer pole, said adjustable tube set is extended horizontally, and said hinge connecting said inner poles and tube set become immobile.

7. The Child Bed Fall Blocking System of claim 6, wherein each said inner pole can move up and down independently without needing any simultaneous manual adjustment of other parts of said Child Bed Fall Blocking System; wherein said hinge facilitates coordinated movement of said inner poles and said tubes when any inner pole is being lowered.

8. The Child Bed Fall Blocking System of claim 1, wherein all components of said system can be manufactured in different dimensions to fit any size bed.

9. The Child Bed Fall Blocking System of claim 1, wherein the entire said system is collapsible and can remain installed into a bed without hindering access or usage of the bed or overall appearance of the bed as said system is collapsible while installed and can be hidden under beddings.

10. The Child Bed Fall Blocking System of claim 1, wherein any corner of each of said adjustable barrier panels can be lowered independently without compromising the protection provided by the remaining said barrier panels.

* * * * *